US010533544B2

(12) United States Patent
Funasaka et al.

(10) Patent No.: US 10,533,544 B2
(45) Date of Patent: Jan. 14, 2020

(54) SWASH PLATE TYPE LIQUID-PRESSURE ROTATING DEVICE AND METHOD OF MANUFACTURING SAME

(71) Applicant: KAWASAKI JUKOGYO KABUSHIKI KAISHA, Kobe-shi, Hyogo (JP)

(72) Inventors: Arata Funasaka, Nishinomiya (JP); Shinji Nishida, Himeji (JP); Masaki Ohnishi, Ashiya (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 434 days.

(21) Appl. No.: 15/304,610

(22) PCT Filed: Mar. 31, 2015

(86) PCT No.: PCT/JP2015/001872
§ 371 (c)(1),
(2) Date: Oct. 17, 2016

(87) PCT Pub. No.: WO2015/166629
PCT Pub. Date: Nov. 5, 2015

(65) Prior Publication Data

US 2017/0037837 A1 Feb. 9, 2017

(30) Foreign Application Priority Data

May 1, 2014 (JP) ..... 2014-094443

(51) Int. Cl.
*F04B 27/10* (2006.01)
*F04B 1/20* (2006.01)
(Continued)

(52) U.S. Cl.
CPC ..... *F04B 27/0865* (2013.01); *F03C 1/0636* (2013.01); *F03C 1/0668* (2013.01);
(Continued)

(58) Field of Classification Search
CPC ..... F04B 1/20; F04B 1/2071; F04B 1/2078–2085; F04B 27/0804;
(Continued)

(56) References Cited

U.S. PATENT DOCUMENTS 3,241,495 A * 3/1966 Diedrich ..... F01B 3/0052 74/60
3,292,553 A 12/1966 Hann
(Continued)

FOREIGN PATENT DOCUMENTS

AT 252678 B 3/1967
GB 1127293 A 9/1968
(Continued)

OTHER PUBLICATIONS

Jun. 23, 2015 International Search Report issued in International Patent Application No. PCT/JP2015/001872.
(Continued)

*Primary Examiner* — Alexander B Comley
(74) *Attorney, Agent, or Firm* — Oliff PLC

(57) ABSTRACT

A swash plate type liquid-pressure rotating device includes a movement restricting mechanism configured to restrict a movement of a spherical bushing relative to a rotating shaft toward a first side in an axial direction. The movement restricting mechanism is a restricting member such that a portion of the spherical bushing which portion is located at the first side in the axial direction contacts the restricting member. The swash plate type liquid-pressure rotating device further includes: a stopper attached to the rotating shaft; and a gap adjusting member. The gap adjusting member is inserted into a gap G3 formed between the stopper and the bearing when the spherical bushing, the retainer plate, the shoe, and the swash plate tightly contact one another in the axial direction. The gap adjusting member
(Continued)

restricts a movement of the rotating shaft relative to the casing toward the first side in the axial direction.

6 Claims, 9 Drawing Sheets

(51) Int. Cl.

| | |
|---|---|
| ***F03C 1/06*** | (2006.01) |
| ***F04B 1/32*** | (2006.01) |
| ***F04B 1/12*** | (2006.01) |
| ***F04B 23/10*** | (2006.01) |
| ***F04B 27/08*** | (2006.01) |

(52) U.S. Cl.
CPC ..... *F03C 1/0671* (2013.01); *F04B 1/126* (2013.01); *F04B 1/2078* (2013.01); *F04B 1/2085* (2013.01); *F04B 1/324* (2013.01); *F04B 27/0804* (2013.01); *F04B 23/106* (2013.01); *F04B 27/1063* (2013.01)

(58) Field of Classification Search
CPC .... F04B 27/0817–0834; F04B 27/0856; F04B 27/0873–0886; F04B 39/14; F04B 53/22; F16C 33/585; F16C 33/605; F03C 1/0605; F03C 1/0623; F03C 1/0636; F03C 1/0665; F03C 1/0671; F03C 1/0668
USPC ..... 384/558; 417/222.1, 222.2, 269, 270, 417/271
See application file for complete search history.

(56) References Cited

U.S. PATENT DOCUMENTS 5,253,576 A * 10/1993 Bethke ..... F04B 1/2085 29/888
2013/0327208 A1 12/2013 Ohno et al.

FOREIGN PATENT DOCUMENTS

JP 2000-205118 A 7/2000
JP 2005127181 A * 5/2005
WO 2012/077157 A1 6/2012

OTHER PUBLICATIONS

Nov. 1, 2016 International Preliminary Report on Patentability issued in International Patent Application No. PCT/JP2015/001872.

* cited by examiner

PRIOR ART

SWASH PLATE TYPE LIQUID-PRESSURE ROTATING DEVICE AND METHOD OF MANUFACTURING SAME

TECHNICAL FIELD

The present invention relates to a swash plate type liquid-pressure rotating device, and particularly to a technology of preventing a shoe of the swash plate type liquid-pressure rotating device from tilting over.

BACKGROUND ART

As swash plate type liquid-pressure rotating devices, swash plate type axial piston pumps and swash plate type axial piston motors have been known. FIG. 11 shows one example of a conventional, typical swash plate type liquid-pressure rotating device 100. The swash plate type liquid-pressure rotating device 100 includes: a rotating shaft 3; a swash plate (not shown), a shoe plate 5*a*, a retainer plate 7, a spherical bushing 8, a cylinder block 9, and a valve plate 4 which are externally fitted to the rotating shaft 3 in this order from one side in an axial direction parallel to a center axis C of the rotating shaft 3; pistons 10 inserted into a plurality of bore holes 91 formed at the cylinder block 9; shoes 6 configured to spherically support respective tip ends of the pistons 10 and be in slide contact with the shoe plate 5*a*; and a set spring 20 provided between the spherical bushing 8 and the cylinder block 9. The retainer plate 7 is provided with a plurality of shoe support holes 71 corresponding to the bore holes 91. Spherical supporting portions 61 of the shoes 6 are inserted through the respective shoe support holes 71. Peripheries of the spherical supporting portions 61 are sandwiched between the swash plate and the retainer plate 7. The spherical bushing 8 rotates integrally with the rotating shaft 3 and spherically supports the retainer plate 7. The cylinder block 9 is pressed against the valve plate 4 by spring force of the set spring 20 and an action of liquid pressure in the bore holes 91, and the shoes 6 are pressed against a slide-contact surface 51 of the shoe plate 5*a* by the retainer plate 7 pressed by the spherical bushing 8.

In the swash plate type liquid-pressure rotating device 100 configured as above, when the cylinder block 9 rotates together with the rotating shaft 3, the pistons 10 perform reciprocating movements in the bore holes 91 along an inclination of the swash plate. When the swash plate type liquid-pressure rotating device 100 serves as the swash plate type axial piston pump, a predetermined amount of low-pressure operating fluid is suctioned to be ejected to a high-pressure side by the movements of the pistons 10. It should be noted that when the rotation of the rotating shaft 3 and the flow of the operating fluid in the swash plate type axial piston pump are reversed, the swash plate type liquid-pressure rotating device 100 serves as the swash plate type axial piston motor.

In the above swash plate type liquid-pressure rotating device 100, when a rotating speed of the rotating shaft 3 increases, reciprocating movement speeds of the pistons 10 increase, and this increases inertial force (shown by an arrow 101 in FIG. 11) by which the pistons 10 pull the shoes 6 toward the valve plate 4. Further, when the rotating speed of the rotating shaft 3 increases, centrifugal force (shown by an arrow 102 in FIG. 11) acting on the shoes 6 increases. Therefore, when force of pressing the shoes 6 against the swash plate exceeds the spring force of the set spring 20 by the increase in the rotating speed of the rotating shaft 3, a slide-contact surface 62 of the shoe 6 partially or entirely separates from the slide-contact surface 51 of the shoe plate 5*a* on the swash plate, and the shoe 6 falls down (hereinafter referred to as "tilts over"). The tilted-over shoe 6 partially contacts the slide-contact surface 51 of the shoe plate 5*a* on the swash plate. Therefore, uneven wear of the shoe plate 5*a* and the shoe 6 occurs, and galling, burning, or the like occurs therebetween. Thus, the shoe 6 and the shoe plate 5*a* are damaged.

To prevent the shoe from tilting over, the applicants of the present application devised a swash plate type liquid-pressure rotating device described in PTL 1. In the swash plate type liquid-pressure rotating device according to this conventional art, when assembling the swash plate type liquid-pressure rotating device, a gap (shown by an arrow G0 in FIG. 11) between the spherical bushing 8 and the cylinder block 9 in the axial direction is filled. With this, the retainer plate is prevented from moving in the axial direction.

CITATION LIST

Patent Literature

PTL 1: International Publication WO2012/077157A1

SUMMARY OF INVENTION

Technical Problem

In the swash plate type liquid-pressure rotating device according to the above conventional art, to fill the gap between the spherical bushing and the cylinder block in the axial direction, a plurality of shim plates, press-fit parts, or the like are used. However, since components of the swash plate type liquid-pressure rotating device have manufacturing errors, the size of the gap between the spherical bushing and the cylinder block in the axial direction varies. Therefore, work of assembling the swash plate type liquid-pressure rotating device is complex, that is, includes the steps of: once assembling the swash plate type liquid-pressure rotating device; measuring the size of the gap between the spherical bushing and the cylinder block in the axial direction and determining the sizes of the shim plates or the like based on the measured size of the gap; partially or entirely disassembling the swash plate type liquid-pressure rotating device; and reassembling the swash plate type liquid-pressure rotating device using the shim plates or the like. As above, regarding the swash plate type liquid-pressure rotating device according to the conventional art, there is still room for improvement in view of assembly workability.

The present invention was made under these circumstances, and an object of the present invention is to provide a swash plate type liquid-pressure rotating device capable of preventing shoes from tilting over and having excellent assembly workability.

Solution to Problem

A swash plate type liquid-pressure rotating device according to the present invention includes: a casing; a rotating shaft inserted through the casing; a bearing through which the rotating shaft is rotatably supported by the casing; a swash plate provided in the casing and including a slide-contact surface inclined relative to an axial direction parallel to a center axis of the rotating shaft; a shoe configured to slide on the slide-contact surface of the swash plate; a retainer plate provided at a first side of the swash plate in the axial direction and configured to sandwich the shoe together with the swash plate in the axial direction to hold the shoe; a spherical bushing externally fitted to the rotating shaft and configured to sandwich the shoe and the retainer plate together with the swash plate in the axial direction to support the retainer plate such that the retainer plate is swingable; a movement restricting mechanism configured to restrict a movement of the spherical bushing relative to the rotating shaft toward the first side in the axial direction; a first stopper member provided at a second side of the bearing in the axial direction and attached to the rotating shaft, the second side being opposite to the first side; and a gap adjusting member configured to be inserted into a gap, formed between the first stopper member and the bearing in the axial direction when the spherical bushing, the retainer plate, the shoe, and the swash plate tightly contact one another in the axial direction, to restrict a movement of the rotating shaft relative to the casing in the axial direction.

In the swash plate type liquid-pressure rotating device, in a state where the spherical bushing, the retainer plate, the shoe, and the swash plate tightly contact one another in the axial direction, an axial position of the rotating shaft relative to the casing is fixed. Therefore, the spherical bushing, the retainer plate, the shoe, and the swash plate cannot move relative to the rotating shaft and the casing in the axial direction. On this account, a distance between the retainer plate and the swash plate which are pressed by the spherical bushing is maintained constant with the shoe tightly contacting the swash plate. Thus, the shoe cannot separate from the swash plate and is prevented from tilting over.

Further, in the swash plate type liquid-pressure rotating device, the first stopper member configured to restrict the movement of the rotating shaft relative to the casing in the axial direction is provided at the second side of the bearing, that is, outside the casing. Therefore, work of bringing the spherical bushing, the retainer plate, the shoe, and the swash plate into tight contact with one another in the axial direction, that is, work of filling gaps among the spherical bushing, the retainer plate, the shoe, and the swash plate in the axial direction can be performed outside the casing. On this account, the work can be performed more easily than a case where the work is performed inside the casing. Thus, the assembly workability of the swash plate type liquid-pressure rotating device improves.

In the above swash plate type liquid-pressure rotating device, it is desirable that a size of the gap adjusting member in the axial direction be adjustable.

Further, in the above swash plate type liquid-pressure rotating device, it is desirable that: the bearing include an outer ring contacting the casing at the first side in the axial direction, an inner ring externally fitted to the rotating shaft at an inner peripheral side of the outer ring, a plurality of rolling elements provided between the outer ring and the inner ring and contacting the outer ring at the first side in the axial direction, and a loose rib contacting the gap adjusting member at the second side in the axial direction and contacting the plurality of rolling elements at the first side in the axial direction; and the inner ring be slidable relative to the plurality of rolling elements in the axial direction.

In the above swash plate type liquid-pressure rotating device, the movement restricting mechanism according to one aspect of the present invention includes: an annular groove formed on an outer peripheral surface of the rotating shaft; a second stopper member externally fitted to a periphery of the annular groove; and a receiving seat formed on an inner peripheral surface of the spherical bushing and contactable with the second stopper member in the axial direction.

In the above swash plate type liquid-pressure rotating device, the movement restricting mechanism according to another aspect of the present invention includes a restricting member provided at the rotating shaft such that a portion of the spherical bushing which portion is located at the first side in the axial direction contacts the restricting member, the restricting member projecting from an outer peripheral surface of the rotating shaft.

In the above swash plate type liquid-pressure rotating device, the movement restricting mechanism according to yet another aspect of the present invention includes a coupling member configured to couple the spherical bushing and the rotating shaft.

In the above swash plate type liquid-pressure rotating device, the movement restricting mechanism according to still another aspect of the present invention includes a step portion formed at the rotating shaft such that a portion of the spherical bushing which portion is located at the first side in the axial direction contacts the step portion.

A method of manufacturing a swash plate type liquid-pressure rotating device according to the present invention includes: providing a spherical bushing, a retainer plate, a shoe held by the retainer plate, and a swash plate around a rotating shaft in this order from a first side to a second side in an axial direction of a rotating shaft rotatably supported in a casing through a bearing; restricting a movement of the spherical bushing relative to the rotating shaft toward the first side in the axial direction; moving the rotating shaft relative to the casing toward the second side in the axial direction to bring the spherical bushing, the retainer plate, the shoe, and the swash plate into tight contact with one another in the axial direction; fitting a gap adjusting member to the rotating shaft such that the gap adjusting member contacts a portion of the bearing which portion is located at the second side in the axial direction; and externally fitting a first stopper member to the rotating shaft such that the first stopper member contacts a portion of the gap adjusting member which portion is located at the second side in the axial direction, to restrict a movement of the rotating shaft relative to the casing toward the first side in the axial direction.

According to the method of manufacturing the swash plate type liquid-pressure rotating device, in a state where the spherical bushing, the retainer plate, the shoe, and the swash plate tightly contact one another in the axial direction, an axial position of the rotating shaft relative to the casing is fixed. Therefore, in the assembled mash plate type liquid-pressure rotating device, the spherical bushing, the retainer plate, the shoe, and the swash plate cannot move relative to the rotating shaft and the casing in the axial direction. On this account, a distance between the retainer plate and the swash plate which are pressed by the spherical bushing is maintained constant with the shoe tightly contacting the swash plate. Thus, the shoe cannot separate from the swash plate and is prevented from tilting over.

Further, according to the method of manufacturing the swash plate type liquid-pressure rotating device, work of restricting the movement of the rotating shaft relative to the casing in the axial direction is performed outside the casing. To be specific, work of bringing the spherical bushing, the retainer plate, the shoe, and the swash plate into tight contact with one another in the axial direction, that is, work of filling gaps among the spherical bushing, the retainer plate, the shoe, and the swash plate in the axial direction is performed outside the casing. On this account, the work can be performed more easily than a case where the work is performed inside the casing. Thus, the assembly workability of the swash plate type liquid-pressure rotating device improves.

In the above method of manufacturing the swash plate type liquid-pressure rotating device, it is desirable that the step of externally fitting the first stopper member to the rotating shaft include: measuring a size of a gap between the bearing and the first stopper member in the axial direction; preparing the gap adjusting member having a size corresponding to the size of the gap in the axial direction; and externally fitting the gap adjusting member to the rotating shaft.

Further, in the above method of manufacturing the swash plate type liquid-pressure rotating device, the step of restricting the movement of the spherical bushing relative to the rotating shaft toward the first side in the axial direction may include: providing a second stopper member at the rotating shaft; and bringing a portion of the spherical bushing into contact with the second stopper member, the portion being located at the first side in the axial direction.

Advantageous Effects of Invention

The present invention can provide the swash plate type liquid-pressure rotating device capable of preventing the shoes from tilting over and having excellent assembly workability.

DESCRIPTION OF EMBODIMENTS

Hereinafter, embodiments of the present invention will be explained. As one aspect of a swash plate type liquid-pressure rotating device according to the present invention, an example in which the present invention is applied to a swash plate type axial piston pump will be explained. In the following explanations and drawings, the same reference signs are used for the same or corresponding components, and a repetition of the same explanation is avoided.

Embodiment 1

Figure 1:
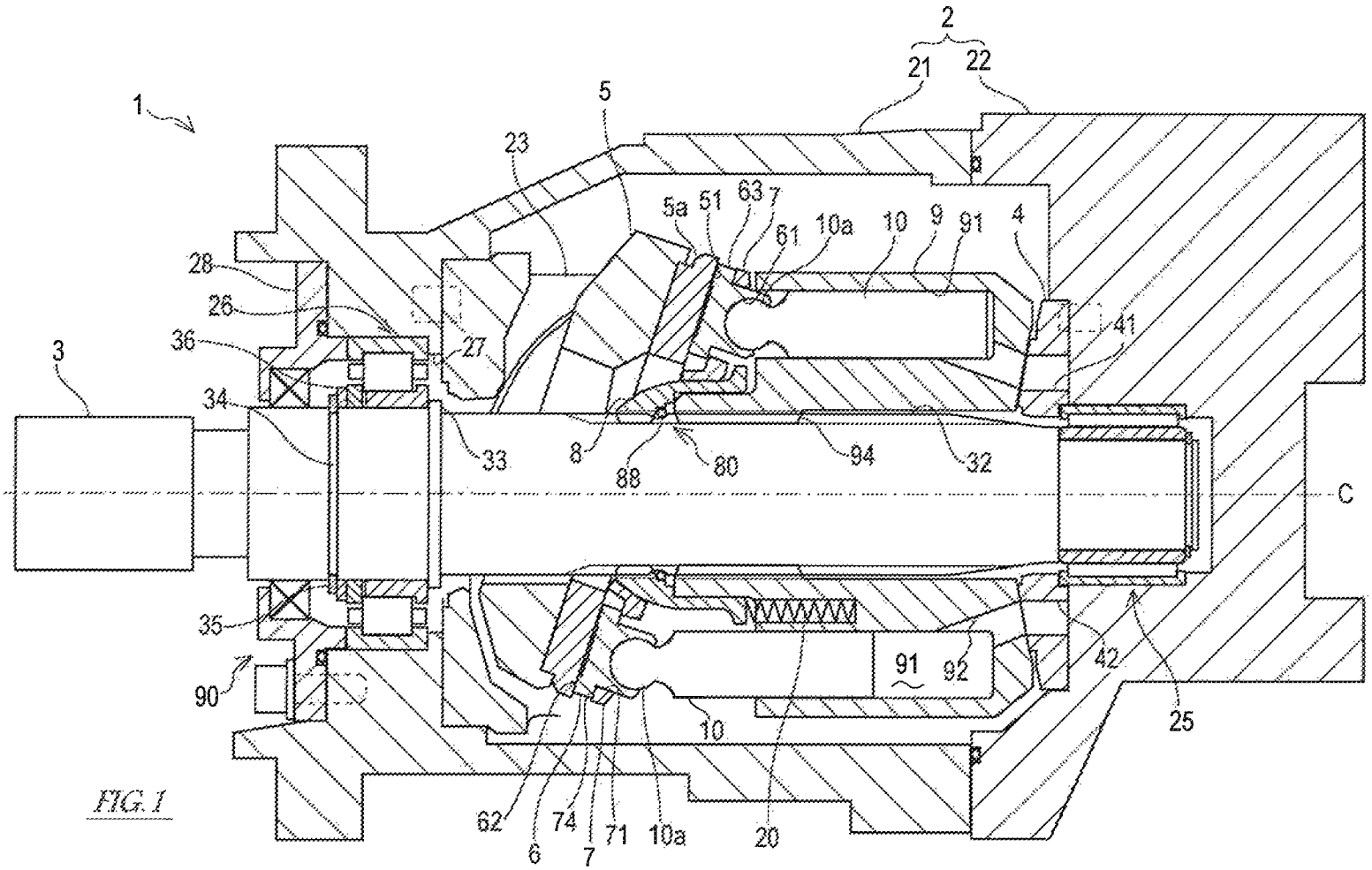
FIG. 1 is a diagram showing an entire configuration of a swash plate type axial piston pump according to Embodiment 1 of the present invention.

FIG. 1 shows a schematic configuration of a swash plate type axial piston pump (hereinafter simply referred to as a "pump 1") according to the present embodiment. The pump 1 includes: a casing 2; a rotating shaft 3 rotatably supported by the casing 2 through bearings 25 and 26; a valve plate 4, a cylinder block 9, a spherical bushing 8 (spherical sliding bearing), a retainer plate 7, and a swash plate 5 which are provided in the casing 2 and externally fitted to the rotating shaft 3; a plurality of pistons 10 slidably inserted into the cylinder block 9; shoes 6 attached to respective head portions 10 of the pistons 10 and configured to slide on a slide-contact surface 51 of the swash plate 5; and a set spring 20 provided between the spherical bushing 8 and the cylinder block 9. The rotating shaft 3 is connected to a driving source (not shown) such as an engine. In the present description, a direction parallel to a center axis C of the rotating shaft 3 is referred to as an "axial direction." Further, for convenience of explanation, a side where the valve plate 4 is provided when viewed from the cylinder block 9 in the axial direction is referred to as "rear (first side)", and an opposite side is referred to as "front (second side)." The following will explain components of the pump 1.

The casing 2 is constituted by a casing main body 21 and a rear cover 22 arranged at a rear side of the casing main body 21 in the axial direction. The casing main body 21 and the rear cover 22 are coupled to each other by a fastening member (not shown), and an inside of the casing 2 is filled with an operating fluid. Bearings 25 and 26 are provided at respective rear and front sides of the casing 2 in the axial direction. The rotating shaft 3 is rotatably supported by the casing 2 through the bearings 25 and 26.

The valve plate 4 is provided at the rear side in the casing 2 in the axial direction. The valve plate 4 is fixed at the front side of the rear cover 22 in the axial direction. It should be noted that the valve plate 4 may be formed integrally with the rear cover 22. The valve plate 4 is an annular plate-shaped member, and the rotating shaft 3 extends through the annular valve plate 4. The valve plate 4 is provided with: at least one inlet port 41 through which the operating fluid (not shown) is supplied to the cylinder block 9; and at least one outlet port 42 through which the operating fluid is discharged from the cylinder block 9. The inlet and outlet ports 41 and 42 communicate with an inlet/outlet passage (not shown) formed at the casing 2.

The cylinder block 9 is provided at the front side of the valve plate 4 in the axial direction. The cylinder block 9 is a thick cylindrical member, and a fitting portion 94 at which a spline is formed in the axial direction is provided on a cylindrical inner peripheral surface of the cylinder block 9. The spline of the cylinder block 9 fits a spline 32 provided on an outer peripheral surface of the rotating shaft 3, and the cylinder block 9 rotates integrally with the rotating shaft 3. The spline 32 is formed at an axial position of the outer peripheral surface of the rotating shaft 3, the axial position corresponding to a region from a rear portion of the cylinder block 9 to a front portion of the swash plate 5.

The cylinder block 9 is provided with a plurality of bore holes 91 that are open toward the front side. The plurality of bore holes 91 are arranged in an annular shape around the rotating shaft 3. A rear portion of the cylinder block 9 slidably contacts a front portion of the valve plate 4, and the inlet and outlet ports 41 and 42 of the valve plate 4 and the bore holes 91 communicate with each other through cylinder ports 92 formed at the cylinder block 9.

The pistons 10 are slidably inserted into the respective bore holes 91 of the cylinder block 9. The pistons 10 perform reciprocating movements in the bore holes 91 in the axial direction. Front portions of the pistons 10 are spherical head portions 10*a* projecting toward the front side from the cylinder block 9. The head portions 10*a* of the pistons 10 are fitted in respective spherical supporting portions 61, formed at respective rear portions of the shoes 6, to be swingably attached to the shoes 6. Circular plate portions 63 larger in diameter than the spherical supporting portions 61 are formed at front portions of the shoes 6, and surfaces of the shoes 6 which surfaces face the front side in the axial direction are slide-contact surfaces 62.

The swash plate 5 is provided at the front side in the casing 2 in the axial direction, that is, the swash plate 5 is provided at the front side of the cylinder block 9 in the axial direction so as to be away from the cylinder block 9. The swash plate 5 is a substantially annular plate-shaped member having a shoe plate 5*a*. A surface of the shoe plate 5*a* which surface faces the rear side in the axial direction is the slide-contact surface 51, and the slide-contact surface 51 is inclined relative to a direction orthogonal to the axial direction. The rotating shaft 3 penetrates the swash plate 5 and the shoe plate 5*a*. A portion of the swash plate 5 which portion is located at the front side in the axial direction is supported by a support base 23 fixed to the casing 2. It should be noted that the support base 23 may be formed integrally with the casing main body 21. Further, the swash plate 5 and the shoe plate 5*a* may be integrated with each other.

The slide-contact surfaces 62 of the shoes 6 slidably contact the slide-contact surface 51 of the shoe plate 5*a*. The swash plate 5 according to the present embodiment is a fixed swash plate in which an inclination (tilting angle) of the slide-contact surface 51 relative to the direction orthogonal to the axial direction is fixed. However, the swash plate 5 according to the present embodiment may be a movable swash plate whose maximum tilting angle is changeable. When the swash plate 5 is the movable swash plate, the swash plate 5 is supported by the support base 23 such that the tilting angle thereof is changeable. In addition, the pump 1 further includes a tilt mechanism configured to change the tilting angle of the swash plate 5 by a servo piston or the like.

The retainer plate 7 is provided between the cylinder block 9 and the swash plate 5 and is located at the rear side of the swash plate 5 in the axial direction. The retainer plate 7 is an annular plate-shaped member including a plurality of shoe support holes 71 corresponding to the pistons 10. The spherical supporting portions 61 of the shoes 6 are fitted in the respective shoe support holes 71 toward the rear side in the axial direction. A surface of the retainer plate 7 which surface faces the front side in the axial direction is a pressing surface 74 facing the slide-contact surface 51 of the swash plate 5. The circular plate portions 63 of the shoes 6 are sandwiched between the slide-contact surface 51 of the swash plate 5 and the pressing surface 74 of the retainer plate 7. As above, the shoes 6 are sandwiched in the axial direction by cooperation of the retainer plate 7 and the swash plate 5.

The spherical bushing 8 is provided between the retainer plate 7 and the cylinder block 9 and is externally fitted to the rotating shaft 3 so as to rotate integrally with the rotating shaft 3. The spherical bushing 8 includes an outer peripheral surface that gradually increases in diameter toward the rear side in the axial direction and is formed by a smooth curved surface. The spherical bushing 8 is inserted into the annular retainer plate 7 toward the front side in the axial direction such that the outer peripheral surface of the spherical bushing 8 and an inner peripheral surface of the retainer plate 7 contact each other. Further, the set spring 20 is provided between the spherical bushing 8 and the cylinder block 9 so as to repel therebetween. By the retainer plate 7 biased by the spring force of the set spring 20 toward the front side in the axial direction, the slide-contact surfaces 62 of the shoes 6 are pressed against the slide-contact surface 51 of the shoe plate 5*a*. As above, since the shoes 6 and the retainer plate 7 are sandwiched in the axial direction by cooperation of the spherical bushing 8 and the swash plate 5, the retainer plate 7 is swingably supported by the spherical bushing 8.

Figure 2:
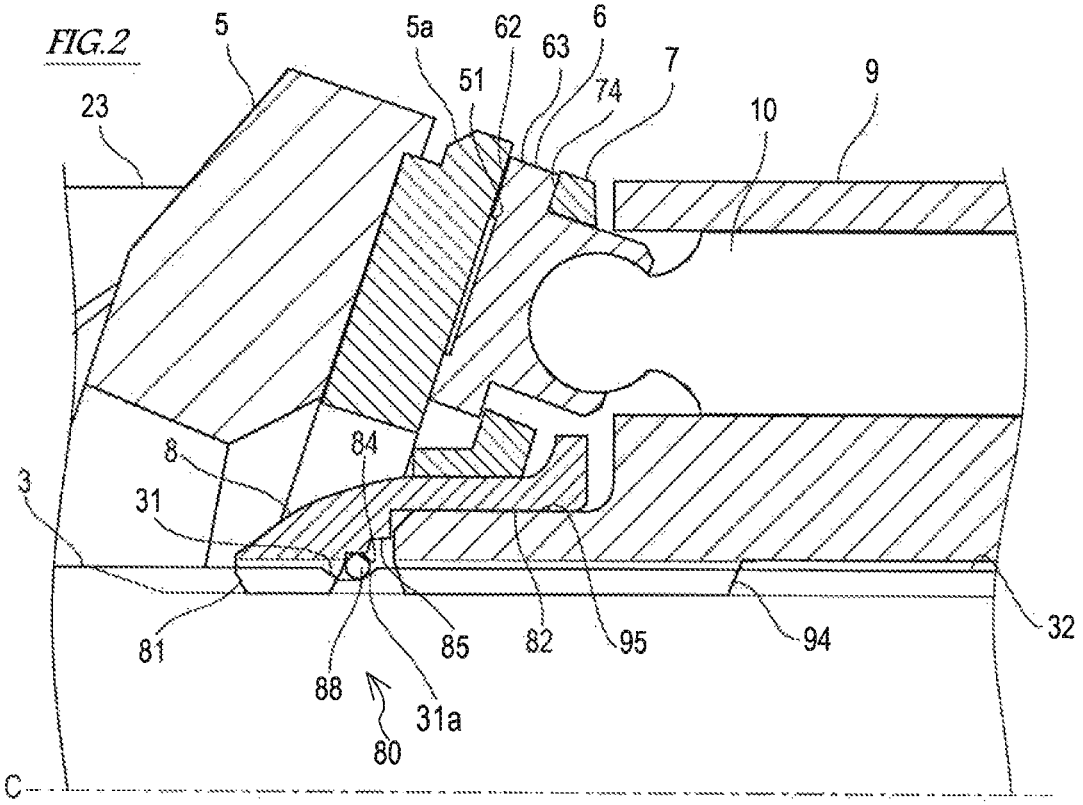
FIG. 2 is an enlarged view showing a spherical bushing and its vicinity.

FIG. 2 shows the spherical bushing 8 and its vicinity. A front portion of the spherical bushing 8 is a fitting portion 81 that fits the rotating shaft 3. A spline extending in the axial direction is formed on an inner peripheral surface of the fitting portion 81, and the spline of the spherical bushing 8 and the spline 32 of the rotating shaft 3 fit each other. A guide portion 95 of the cylinder block 9 is inserted into a guide portion 82 that is a rear portion of the spherical bushing 8.

Figure 3:
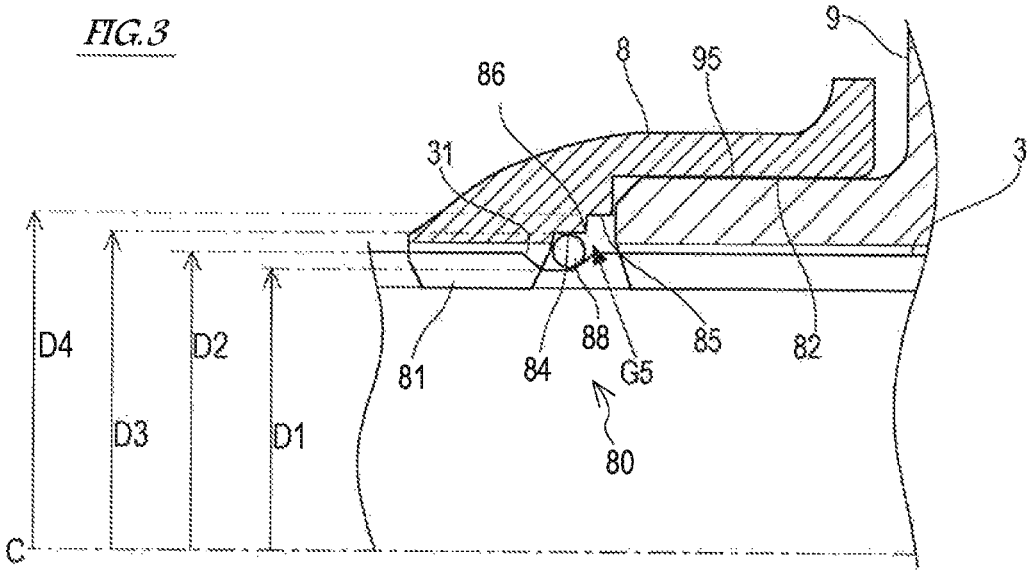
FIG. 3 is a diagram for explaining a first movement restricting mechanism.
Figure 4:
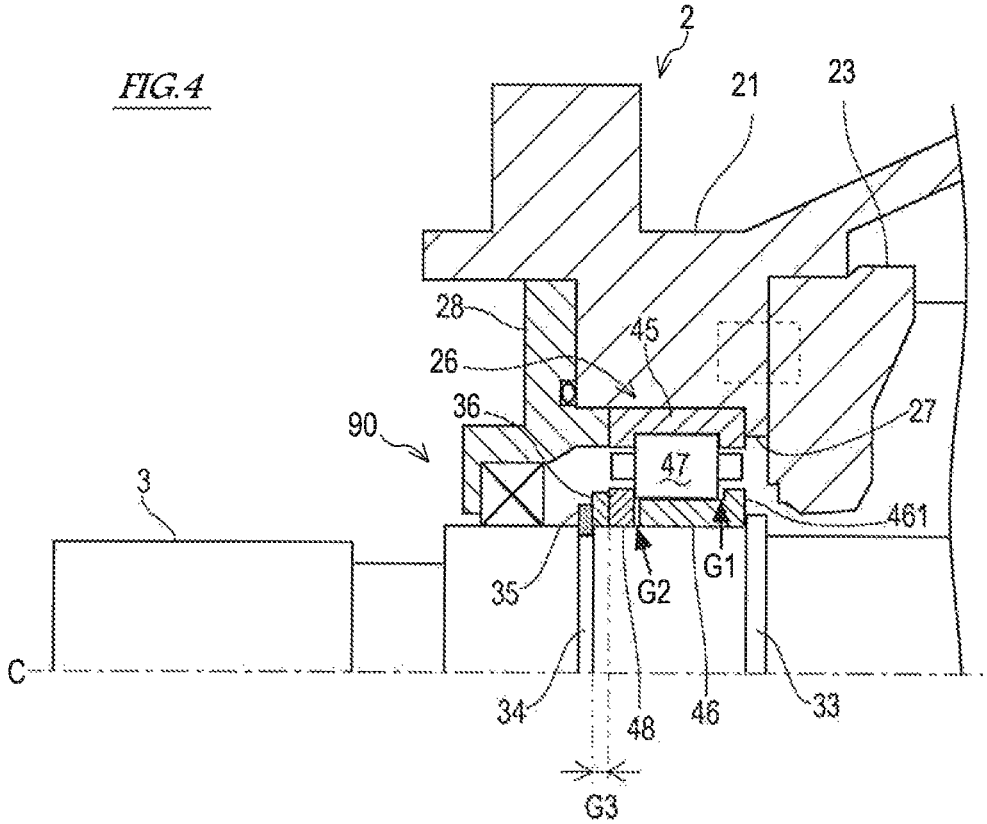
FIG. 4 is an enlarged view showing a portion where a rotating shaft is supported by a casing main body.

The pump 1 configured as above is provided with: a first movement restricting mechanism 80 configured to restrict a movement of the spherical bushing 8 relative to the rotating shaft 3 toward the rear side in the axial direction as shown in FIGS. 2 and 3; and a second movement restricting mechanism 90 configured to restrict a movement of the rotating shaft 3 relative to the casing 2 toward the rear side in the axial direction as shown in FIG. 4.

First, the first movement restricting mechanism 80 will be explained in detail. As shown in FIGS. 2 and 3, the first movement restricting mechanism 80 is substantially constituted by: an annular outward groove 31 formed on the outer peripheral surface of the rotating shaft 3; a C ring 88 (second stopper member) fitted to a periphery of the outward groove 31; and inward grooves 84 and 85 formed on an inner peripheral surface of the spherical bushing 8.

The outward groove 31 is an annular groove formed on the outer peripheral surface of the rotating shaft 3 and has an outer diameter smaller than an outer diameter of the other portion of the rotating shaft 3. In the pump 1 in an assembled state, the outward groove 31 is formed at an axial position corresponding to the first groove 84 of the spherical hushing 8. At least a portion of the outward groove 31 which portion is located at the rear side in the axial direction is an oblique surface 31*a* that is smoothly connected to the outer peripheral surface of the rotating shaft 3. It should be noted that the oblique surface 31*a* may be a curved surface having a circular-arc cross section.

The C ring 88 is externally fitted to the outward groove 31 of the rotating shaft 3. The C ring 88 has an inner diameter smaller than an outer diameter D1 of the outward groove 31 in a steady state where any load is not applied to the C ring 88. To be specific, the C ring 88 in an elastically deformed state is fitted in the outward groove 31. A relation between the outer diameter of the outward groove 31 and the size of the C ring 88 is defined such that the outer diameter of the C ring 88 fitted in the outward groove 31 is larger than an outer diameter D2 of the rotating shaft 3. To be specific, at least a part of the C ring 88 fitted in the outward groove 31 projects toward an outer peripheral side beyond the outer peripheral surface of the rotating shaft 3.

The inward grooves 84 and 85 are two annular grooves formed on the inner peripheral surface of the spherical bushing 8 and adjacent to each other in the axial direction. The first groove 84 includes an annular receiving seat 84*a* (a front end surface of the first groove 84) that contacts in the axial direction the C ring 88 fitted in the outward groove 31 of the rotating shaft 3 when the assembling is completed. The second groove 85 is a space in which the C ring 88 fitted to the outer peripheral surface of the rotating shaft 3 can be accommodated during assembly work. The first groove 84 is located at the front side of the second groove 85 in the axial direction. By the C ring 88 fitted between the outward groove 31 of the rotating shaft 3 and the first groove 84 of the spherical bushing 8, a movement of the spherical bushing 8 relative to the rotating shaft 3 toward the rear side in the axial direction is restricted, and a movement of the rotating shaft 3 relative to the spherical bushing 8 toward the front side in the axial direction is restricted. To be specific, by moving the rotating shaft 3 toward the front side in the axial direction, the spherical bushing 8 moves toward the front side in the axial direction without changing its position relative to the rotating shaft 3.

Figure 5:
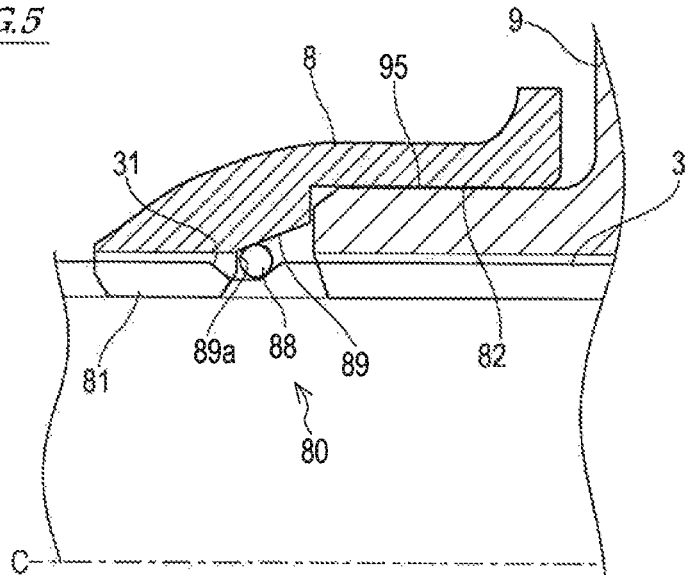
FIG. 5 is a diagram showing another shape of a groove formed on the spherical bushing.

An inner diameter D3 of the first groove 84 is smaller than an inner diameter D4 of the second groove 85. The inner diameter D3 of the first groove 84 is defined so as to be substantially equal to the outer diameter of the C ring 88 fitted in the outward groove 31 of the rotating shaft 3. Further, the inner diameter D4 of the second groove 85 is defined so as to be substantially equal to the outer diameter of the C ring 88 fitted to the outer periphery of the rotating shaft 3. Furthermore, an inner diameter of a boundary portion 86 between the first groove 84 and the second groove 85 in the axial direction is defined such that the C ring 88 fitted in the outward groove 31 of the rotating shaft 3 and the first groove 84 of the spherical bushing 8 cannot move from a gap G5 of the boundary portion 86 to the second groove 85. It should be noted that a groove formed on the inner peripheral surface of the spherical bushing 8 and accommodating the C ring 88 does not have to be constituted by two grooves that are the first groove 84 and the second groove 85. For example, as shown in FIG. 5, the groove formed on the inner peripheral surface of the spherical bushing 8 and accommodating the C ring 88 may be constituted by a single groove 89 that decreases in diameter from a rear end portion of the groove toward a front end portion thereof. In this case, a rear portion of the groove 89 is a space that can accommodate the C ring 88 fitted to the outer peripheral surface of the rotating shaft 3 during the assembly work. Further, the front end portion of the groove 89 includes an annular receiving seat 89*a* (a front end surface of the groove that decreases in diameter) that contacts in the axial direction the C ring 88 fitted in the outward groove 31 of the rotating shaft 3 when the assembling is completed.

Next, the second movement restricting mechanism 90 will be explained. FIG. 4 shows a portion where the rotating shaft 3 is supported by the casing main body 21. The second movement restricting mechanism 90 is provided between the casing 2 and a portion of the rotating shaft 3 which portion projects from the casing 2 toward the front side in the axial direction. The second movement restricting mechanism 90 is constituted by: a stopper 35 (first stopper member) attached to the rotating shaft 3 so as to face the bearing 26 in the axial direction outside the casing 2; and a gap adjusting member 36 provided between the stopper 35 and the bearing 26.

An opening of the casing 2 into which opening the rotating shaft 3 is inserted is provided with an opening edge 27 projecting toward an inner peripheral side. The bearing 26 is substantially constituted by: an outer ring 45 that contacts the opening edge 27 at the rear side in the axial direction; an inner ring 46 located at an inner peripheral side of the outer ring 45 and externally fitted to the rotating shaft 3; a plurality of rolling elements 47 provided between the outer ring 45 and the inner ring 46; and a loose rib 48 that contacts the gap adjusting member 36 at the front side in the axial direction and contacts the rolling elements 47 at the rear side in the axial direction. The outer ring 45 is sandwiched by the opening edge 27 and a front cover 28 from both sides in the axial direction, the front cover 28 being fixed to the casing main body 21. Further, flanges are formed at both sides of the outer ring 45 in the axial direction, and the rolling elements 47 are sandwiched by the flanges of the outer ring 45 from both sides in the axial direction. At least portions of the rolling elements 47 which portions are located at the rear side in the axial direction contact the outer ring 45. A portion of the inner ring 46 which portion is located at the rear side in the axial direction contacts a flange portion 33 in the axial direction, the flange portion 33 being formed at the rotating shaft 3. The flange portion 33 is an annular convex portion provided at the rear side of an annular groove 34 in the axial direction and formed on the outer peripheral surface of the rotating shaft 3.

A gap G1 in the axial direction is formed between a flange 461 of the inner ring 46 and each of the rolling elements 47. Further, a gap G2 in the axial direction is formed between the inner ring 46 and the loose rib 48. By these gaps G1 and G2, the inner ring 46 can slide in the axial direction relative to the rolling elements 47. Therefore, when the loose rib 48 is pressed toward the rear side in the axial direction, this pressing force acts on the loose rib 48, the rolling elements 47, and the outer ring 45 but does not act on the inner ring 46.

A gap G3 between the loose rib 48 and the stopper 35 in the axial direction is different for each pump 1, that is, a size in the axial direction of a space in which the gap adjusting member 36 is provided is different for each pump 1. Therefore, the size of the gap adjusting member 36 in the axial direction is adjustable. For example, to adjust the size of the gap adjusting member 36 in the axial direction, plural types of gap adjusting members having different sizes in the axial direction are prepared. In accordance with the size of the gap G3 between the loose rib 48 of the bearing 26 and the stopper 35 in the axial direction, one or a plurality of gap adjusting members 36 having appropriate sizes which can fill the gap G3 are selectively used. Further, for example, to adjust the size of the gap adjusting member 36 in the axial direction, a plurality of gap adjusting members stacked in the axial direction may be used as the gap adjusting member 36. In this case, in accordance with the size of the gap G3 between the loose rib 48 and the stopper 35 in the axial direction, the number of gap adjusting members used to fill the gap G5 is increased or decreased. It should be noted that the gap adjusting member 36 may be one of a collar, a spacer, a shim, and a bearing nut or a combination of two or more of collars, spacers, shims, and bearing nuts.

Figure 6:
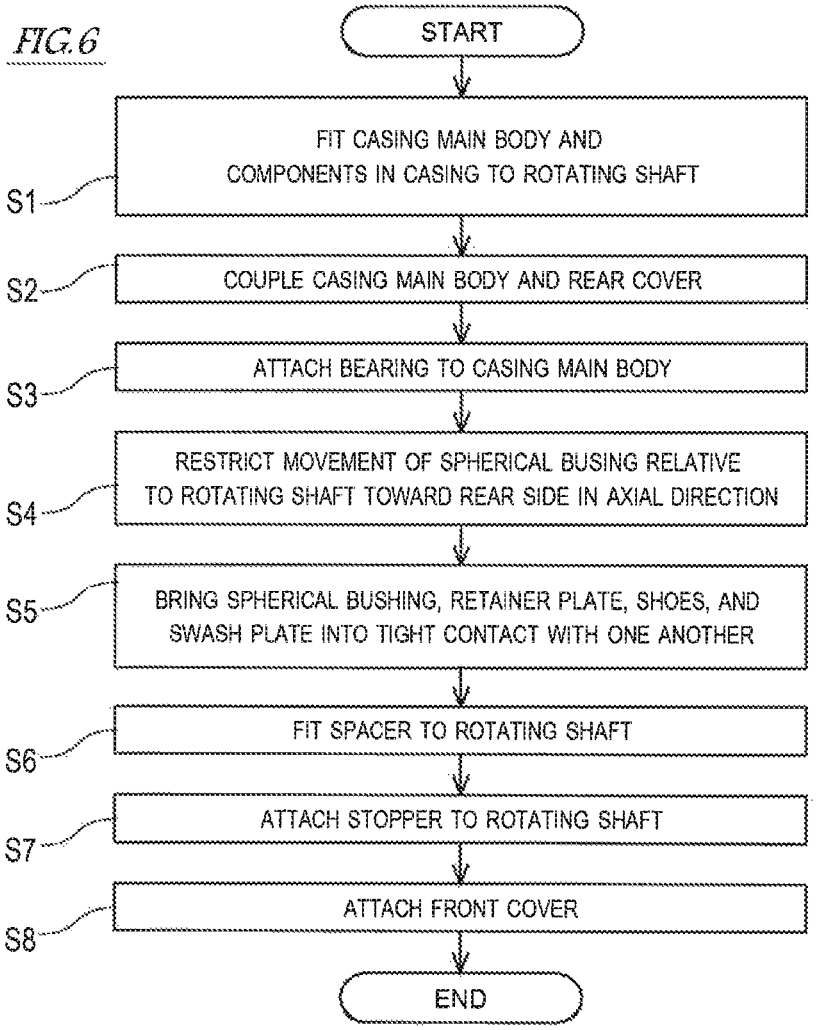
FIG. 6 is a flow chart for explaining a procedure of assembling the swash plate type axial piston pump.

Next, a procedure of assembling the pump 1 configured as above will be explained. FIG. 6 is a flow chart for explaining the procedure of assembling the swash plate type axial piston pump.

As shown in FIG. 6, first, the casing main body 21 and the components (i.e., the swash plate 5, the shoes 6, the retainer plate 7, the spherical bushing 8, the C ring 88, the cylinder block 9, and the valve plate 4) provided in the casing 2 are fitted to the rotating shaft 3 (Step S1).

Since there are various procedures of fitting the casing main body 21 and the components in the casing 2 to the rotating shaft 3, the following will explain one example of the procedures. First, the support base 23 and the swash plate 5 are attached to the casing main body 21. Next, an assembly is prepared by integrally assembling: the shoes 6; the retainer plate 7 to which the shoes 6 are fitted; the pistons 10 supported by the shoes 6; the spherical bushing 8; the cylinder block 9 into which the pistons 10 are inserted; and the rotating shaft 3. At this time, the C ring 88 is externally fitted to the outer peripheral surface of the rotating shaft 3 so as to be located between the spherical bushing 8 and the cylinder block 9. Then, the assembly is assembled to the casing main body 21. Further, the valve plate 4 is fitted to the rotating shaft 3 from an axial rear end of the rotating shaft 3 toward the front side.

Figure 7:
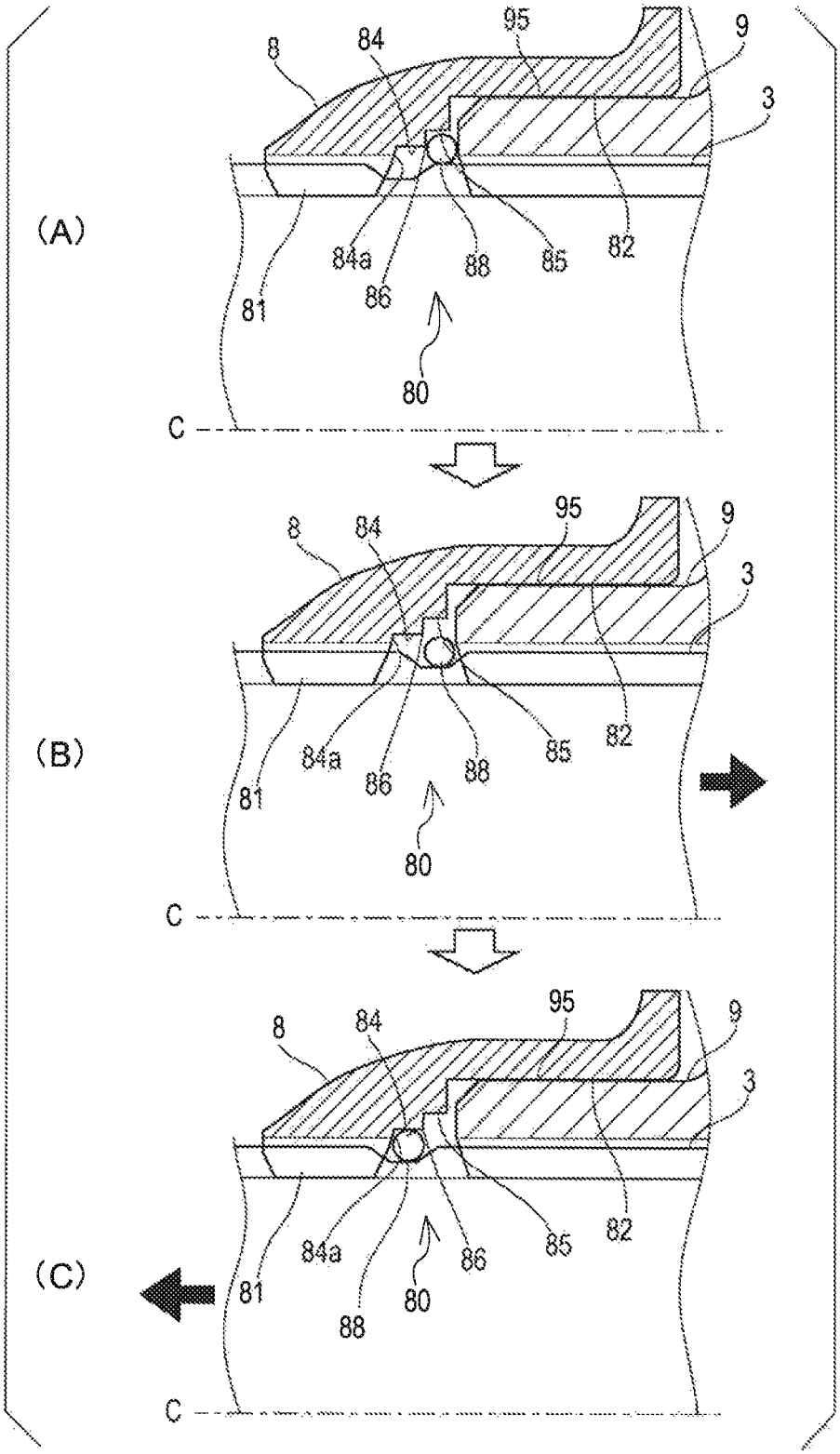
FIG. 7 is a diagram showing a flow of restricting a movement of the spherical bushing relative to the rotating shaft toward a front side in an axial direction.

Next, the rear cover 22 is attached at the rear side of the casing main body 21, and the casing main body 21 and the rear cover 22 are coupled to each other (Step S2). Before the casing main body 21 and the rear cover 22 are coupled to each other, the bearing 25 is attached between the rotating shaft 3 and the rear cover 22. At this stage, the C ring 88 is fitted between the outer peripheral surface of the rotating shaft 3 and the second groove 85 of the spherical bushing 8 (see FIG. 7A).

Next, the bearing 26 is attached at the front side of the casing 2 (Step S3). It should be noted that Step S3 may be performed after Step S4 described later.

Next, a movement of the spherical bushing 8 relative to the rotating shaft 3 toward the rear side in the axial direction is restricted (Step S4). First, the rotating shaft 3 is pushed toward the rear side in the axial direction relative to the casing 2 to be moved toward the rear side in the axial direction relative to the casing 2. With this, the rotating shaft 3 moves toward the rear side in the axial direction relative to the spherical bushing 8 and the cylinder block 9, so that the C ring 88 fitted to the outer peripheral surface of the rotating shaft 3 is pressed toward the front side in the axial direction by the cylinder block 9. Thus, the C ring 88 moves along the oblique surface 31*a* to be fitted in the outward groove 31 (see FIG. 7B).

Next, the rotating shaft 3 is pulled toward the front side in the axial direction from the casing 2 to be moved toward the front side in the axial direction relative to the casing 2. Here, the rotating shaft 3 is moved toward the front side in the axial direction relative to the spherical bushing 8 and the cylinder block 9 until the C ring 88 externally fitted in the outward groove 31 contacts the receiving seat 84*a* that is the front end surface of the first groove 84 of the spherical bushing 8 (see FIG. 7C). Once the C ring 88 is located between the outward groove 31 of the rotating shaft 3 and the first groove 84 of the spherical bushing 8, the C ring 88 cannot get out thereof. When the receiving seat 84*a* that is a portion of the spherical bushing 8 which portion is located at the rear side in the axial direction contacts the C ring 88 fixed to the rotating shaft 3 as above, the movement of the spherical bushing 8 relative to the rotating shaft 3 toward the rear side in the axial direction is restricted.

Next, by continuing the movement of the rotating shaft 3 toward the front side in the axial direction, the spherical bushing 8, the retainer plate 7, the shoes 6, and the swash plate 5 are brought into tight contact with one another in the axial direction (Step S5). When the rotating shaft 3 further moves toward the front side in the axial direction relative to the casing 2 in a state where the movement of the spherical bushing 8 relative to the rotating shaft 3 toward the rear side in the axial direction is restricted as above, the spherical bushing 8, the retainer plate 7, and the shoes 6 (and the pistons 10 including the head portions 10*a* held by the shoes 6) move toward the front side in the axial direction in accordance with the rotating shaft 3. With this, the retainer plate 7 and the shoe 6 can be sandwiched and pressurized between the swash plate 5 and the spherical bushing 8. Then, until the spherical bushing 8, the retainer plate 7, the shoes 6, and the swash plate 5 tightly contact one another in the axial direction, the rotating shaft 3 is moved toward the rear side in the axial direction.

Next, the gap adjusting member 36 is fitted to the rotating shaft 3 from an axial front end of the rotating shaft 3 toward the rear side (Step S6). Here, first, the size of the gap G3 between the bearing 26 and the stopper 35 in the axial direction is measured. At this time, the stopper 35 may be temporarily fixed to the rotating shaft 3. Then, to fill the gap G3 with the gap adjusting member 36, the gap adjusting member 36 whose size in the axial direction corresponds to the measured size of the gap G3 is prepared. Preparing the gap adjusting member 36 includes one or more of: selecting a suitable gap adjusting member from plural types of gap adjusting members; combining a plurality of gap adjusting members; changing the size of the gap adjusting member by machine work or the like; determining the number of gap adjusting members stacked; and the like. Then, the prepared gap adjusting member 36 having the above size in the axial direction is fitted to the rotating shaft 3 from the axial front end of the rotating shaft 3 toward the rear side.

Next, the stopper 35 is attached to the rotating shaft 3 (Step S7). With this, the components provided between the C ring 88 and the stopper 35 tightly contact with one another in the axial direction. Finally, the front cover 28 is fixed to the casing main body 21 (Step S8). By Steps S1 to S8 described above, the pump 1 can be assembled.

According to the above-explained procedure of assembling the pump 1, the movement of the spherical bushing 8 relative to the rotating shaft 3 toward the rear side in the axial direction is restricted by the first movement restricting mechanism 80, and then, the spherical bushing 8, the retainer plate 7, the shoes 6, and the swash plate 5 are brought into tight contact with one another in the axial direction until the shoes 6 tightly contact the swash plate 5. With this, gaps among the components that are the spherical bushing 8, the retainer plate 7, the shoes 6, and the swash plate 5 in the axial direction are eliminated, and only the gap between the bearing 26 and the stopper 35 remains. This gap is filled by the gap adjusting member 36.

In the procedure of assembling the pump 1, the size of the gap G3 between the bearing 26 and the stopper 35 in the axial direction varies depending on manufacturing errors of the components. Therefore, the size of the gap adjusting member 36 that fills the gap G3 needs to be adjusted. In the present embodiment, since the gap G3 is formed outside the casing 2, work of providing the gap adjusting member 36, that is, work of filling the gap G3 is easier than that when the gap is formed inside the casing 2. To be specific, it is unnecessary to disassemble the assembled components for the purpose of measuring the manufacturing errors of the components. Further, the work of providing the gap adjusting member 36 in the gap G3 is also easy. In the work of assembling the swash plate type liquid-pressure rotating device (pump) 100 according to the conventional art, the steps of measuring the gap, disassembling the assembled components, and reassembling the components are performed. However, these steps become unnecessary, and the assembly work can be simplified. Further, risks of damages of parts by disassembling and reassembling can be reduced. Since the assembly workability of the pump 1 improves as above, the productivity of the pump 1 can be improved.

Next, the operations of the pump 1 configured as above will be explained. When the rotating shaft 3 is rotated, the cylinder block 9, the pistons 10, the shoes 6, the retainer plate 7, and the spherical bushing 8 rotate around the rotating shaft 3 integrally with the rotating shaft 3. Here, the cylinder block 9 is in slide contact with the valve plate 4 and rotates relative to the valve plate 4, and the ports 41 and 42 with which the bore holes 91 of the cylinder block 9 communicate through the cylinder ports 92 are switched. Each of the pistons 10 performs the reciprocating movement in the bore hole 91 in accordance with a stroke corresponding to the tilting angle of the swash plate 5. In a suction stroke in which the piston 10 is pushed and moved from a top dead center to a bottom dead center, the operating fluid is suctioned from the inlet/outlet passage through the inlet port 41 to the bore hole 91. In a discharge stroke in which the piston 10 is returned from the bottom dead center to the top dead center, the operating fluid suctioned in the bore hole 91 is discharged as a high-pressure operating fluid through the outlet port 42 to the inlet/outlet passage.

In the pump 1 configured to operate as above, when the rotating shaft. 3 rotates at high speed in a state where the pressure of the fluid in the bore holes 91 is decreased by low-pressure driving or the like, a moment that causes the shoes 6 to tilt over by inertial force and centrifugal force generated when the pistons 10 move toward the rear side (first side) where the valve plate 4 is provided when viewed from the cylinder block 9 may become larger than the spring force of the set spring 20.

In the pump 1 according to the present embodiment, the components provided between the C ring 88 and the stopper 35 (i.e., the spherical bushing 8, the retainer plate 7, the shoes 6, the swash plate 5, the support base 23, the casing main body 21, the bearing 26, and the gap adjusting member 36) tightly contact one another in the axial direction. Relative axial positions of the above components that tightly contact one another are fixed. Therefore, a distance between the pressing surface 74 of the retainer plate 7 and the slide-contact surface 51 of the swash plate 5 in the axial direction is maintained constant. To be specific, the positions of the shoes 6 sandwiched between the retainer plate 7 and the swash plate 5 do not change relative to the other components. Therefore, even when the rotating shaft 3 rotates at high speed as above, the slide-contact surfaces 62 of the shoes 6 cannot separate from the slide-contact surface 51 of the swash plate 5. On this account, the shoes 6 can be prevented from floating and tilting over, and damages of the shoes 6 and the swash plate 5 by partial-contact of the shoes 6 with respect to the swash plate 5 can be prevented. Since the shoes 6 do not tilt over even when the rotating speed of the rotating shaft 3 increases, the rotating speed of the pump 1 can be further increased.

Further, in the pump 1 according to the present embodiment, it is unnecessary to increase the spring force of the set spring 20 for the purpose of preventing the shoes 6 from tilting over. If the spring force of the set spring 20 is increased to such a degree that the shoes 6 can be prevented from tilting over, this increase in the spring force causes problems that: efficiency decreases by an increase in frictional force between the swash plate 5 and each shoe 6; and burning occurs at the swash plate 5 and the shoes 6. In the pump 1, such problems do not occur since the spring force of the set spring 20 has not changed from before.

Embodiment 2

Next, Embodiment 2 will be explained. The first movement restricting mechanism 80 according to the above embodiment is one example of a mechanism configured to restrict the movement of the spherical bushing 8 relative to the rotating shaft 3 toward the rear side in the axial direction. The first movement restricting mechanism 80 according to the present invention is not limited to Embodiment 1 and may be another mechanism as long as the mechanism can restrict the movement of the spherical bushing 8 relative to the rotating shaft 3 toward the rear side in the axial direction. The following will explain a swash plate type axial piston pump (hereinafter simply referred to as a "pump 1A") according to Embodiment 2 including a first movement restricting mechanism 80A that is different from the first movement restricting mechanism 80 of Embodiment 1. It should be noted that the pump 1A is different from the pump 1 of Embodiment 1 mainly regarding the first movement restricting mechanism 80. Therefore, in the explanation of the present embodiment, the same reference signs are used for the same or similar components as in Embodiment 1, and a repetition of the same explanation may be avoided.

Figure 8:
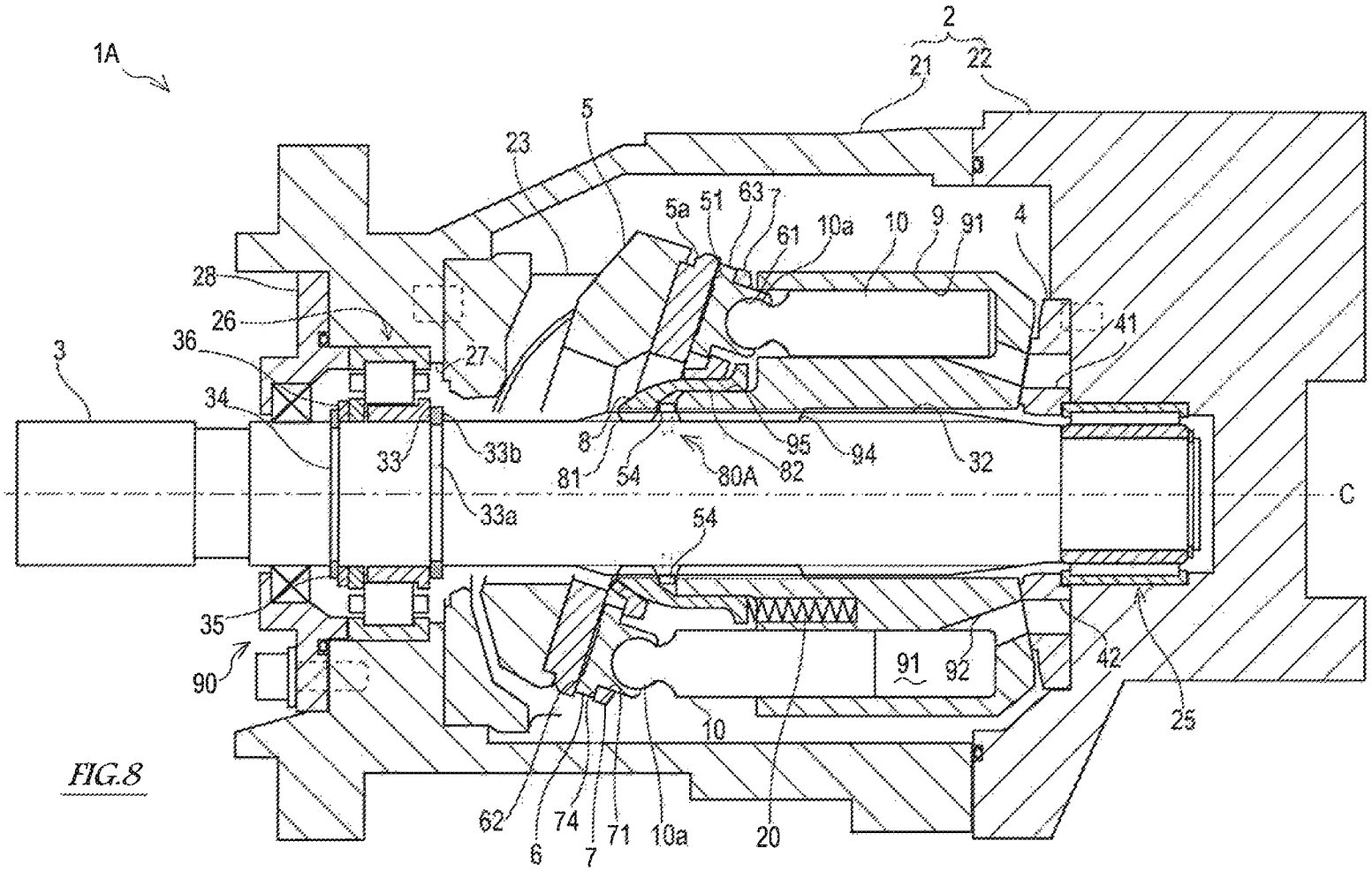
FIG. 8 is a diagram showing an entire configuration of the swash plate type axial piston pump according to Embodiment 2 of the present invention.

FIG. 8 shows a schematic configuration of the pump 1A according to Embodiment 2. In the pump 1A, a restricting member 54 is provided between the fitting portion 81 of the spherical bushing 8 and the cylinder block 9 in the axial direction. The restricting member 54 restricts the movement of the spherical bushing 8 relative to the rotating shaft 3 toward the rear side in the axial direction. The restricting member 54 is fixed to the rotating shaft 3 and can move in the axial direction integrally with the rotating shaft 3. Examples of the restricting member 54 include: at least one pin inserted into the rotating shaft 3 in a direction orthogonal to the axial direction; and a stop ring fitted to the rotating shaft 3.

Further, in the pump 1A, the flange portion 33 of the rotating shaft 3 is constituted by an annular groove 33*a* formed around the rotating shaft 3; and a stop ring 33*b* fitted in the groove 33*a*. With this, the components such as the spherical bushing 8 and the retainer plate 7 can be fitted to the rotating shaft 3 from the axial front end of the rotating shaft 3 toward the rear side.

Next, one example of a procedure of assembling the pump 1A will be explained.

First, the casing main body 21 and the components (i.e., the swash plate 5, the shoes 6, the retainer plate 7, the spherical bushing 8, the cylinder block 9, and the valve plate 4) provided in the casing 2 are fitted to the rotating shaft 3. Here, first, the support base 23 and the swash plate 5 are attached to the casing main body 21. Next, the restricting member 54 is fixed to the rotating shaft 3. Then, the shoes 6, the pistons 10, the retainer plate 7, and the spherical bushing 8 are fitted to the rotating shaft 3 from the axial front end of the rotating shaft 3 toward the rear side. Further, the cylinder block 9 is fitted to the rotating shaft 3 from the axial rear end of the rotating shaft 3 toward the front side, and the pistons 10 are inserted into the bore holes 91. Here, the set spring 20 is arranged between the spherical bushing 8 and the cylinder block 9. Further, the valve plate 4 is fitted to the rotating shaft 3 from the axial rear end of the rotating shaft 3 toward the front side.

Next, the rear cover 22 is attached at the rear side of the casing main body 21, and the casing main body 21 and the rear cover 22 are coupled to each other. Before the casing main body 21 and the rear cover 22 are coupled to each other, the bearing 25 is attached between the rotating shaft 3 and the rear cover 22.

Next, the movement of the spherical bushing 8 relative to the rotating shaft 3 toward the rear side in the axial direction is restricted. Here, the rotating shaft 3 is pulled toward the front side in the axial direction from the casing 2 to be moved toward the front side in the axial direction relative to the casing 2. When the receiving seat that is a portion of the spherical bushing 8 which portion is located at the rear side in the axial direction contacts the restricting member 54, the movement of the spherical bushing 8 relative to the rotating shaft 3 toward the rear side in the axial direction is restricted.

Next, the rotating shaft 3 is further moved toward the front side in the axial direction relative to the casing 2. Thus, the spherical bushing 8, the retainer plate 7, the shoes 6, and the swash plate 5 are brought into tight contact with one another in the axial direction.

Next, the stop ring 33*b* is fitted in the groove 33*a* of the rotating shaft 3. With this, the flange portion 33 is formed at the rotating shaft 3. Then, the bearing 26 is attached at the front side of the casing 2. The bearing 26 and the gap adjusting member 36 are fitted in this order to the rotating shaft 3 from the axial front end of the rotating shaft 3 toward the rear side, and the stopper 35 is further attached to the rotating shaft 3. Finally, the front cover 28 is fixed to the casing main body 21. The pump 1A can be assembled by the above assembling procedure.

Embodiment 3

Next, Embodiment 3 will be explained. The following will explain a swash plate type axial piston pump (hereinafter simply referred to as a "pump 1B") according to Embodiment 3 including a first movement restricting mechanism 80B that is different from the first movement restricting mechanism 80 of Embodiment 1. It should be noted that the pump 1B is different from the pump 1 of Embodiment 1 mainly regarding the first movement restricting mechanism 80. Therefore, in the explanation of the present embodiment, the same reference signs are used for the same or similar components as in Embodiment 1, and a repetition of the same explanation may be avoided.

Figure 9:
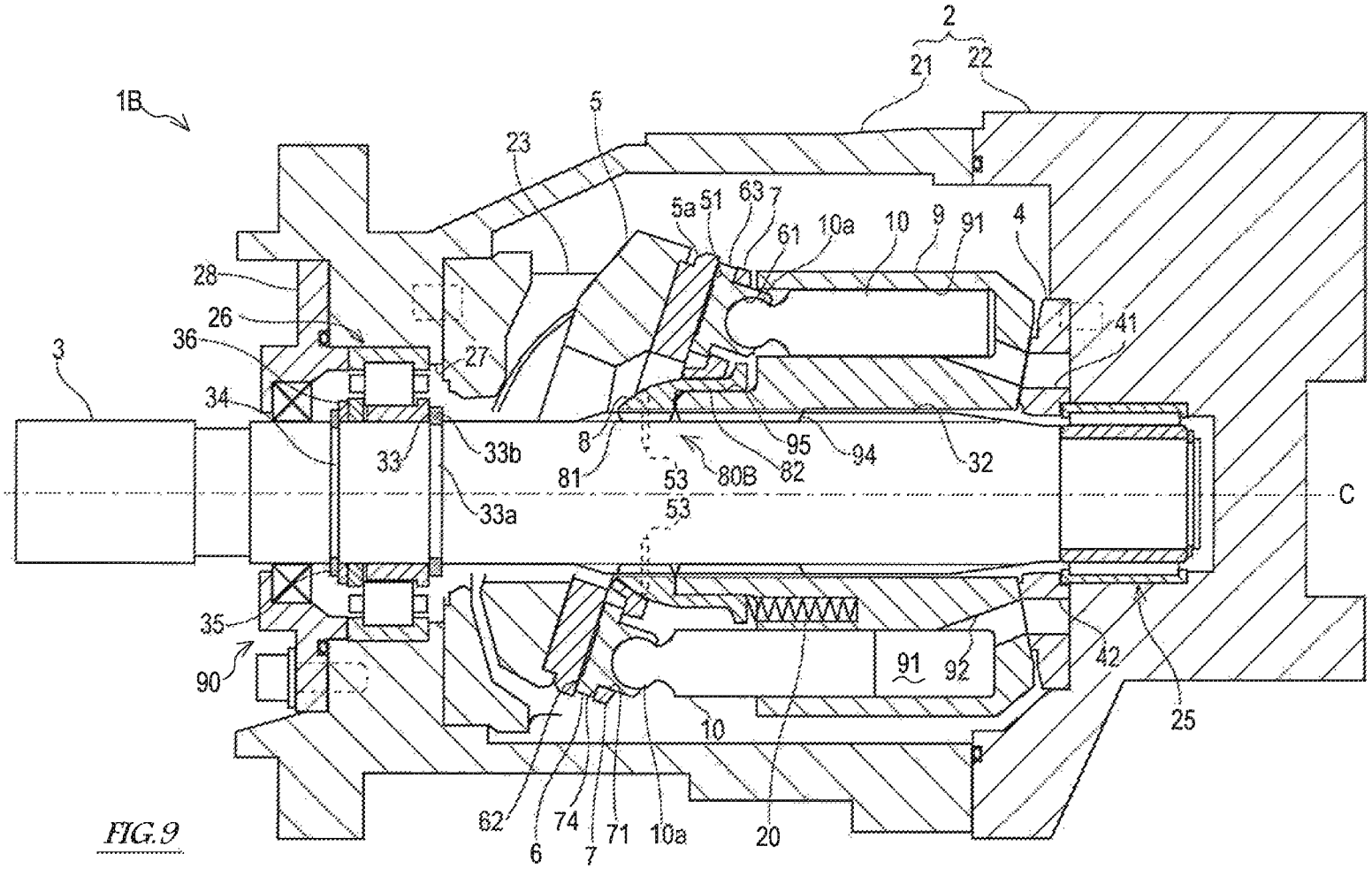
FIG. 9 is a diagram showing an entire configuration of the swash plate type axial piston pump according to Embodiment 3 of the present invention.

FIG. 9 shows a schematic configuration of the pump 1B according to Embodiment 3. In the pump 1B, the movement of the spherical bushing 8 relative to the rotating shaft 3 toward the rear side in the axial direction is restricted by a coupling member 53 that penetrates the spherical bushing 8 and the rotating shaft 3 in a direction orthogonal to the axial direction. For example, a pin can be used as the coupling member 53.

Further, in the pump 1B, the flange portion 33 of the rotating shaft 3 is constituted by: the annular groove 33*a* formed around the rotating shaft 3; and the stop ring 33*b* fitted in the groove 33*a*. With this, the components such as the spherical bushing 8 and the retainer plate 7 can be fitted to the rotating shaft 3 from the axial front end of the rotating shaft 3 toward the rear side.

Next, one example of a procedure of assembling the pump 1B will be explained.

First, the casing main body 21 and the components (i.e., the swash plate 5, the shoes 6, the retainer plate 7, the spherical bushing 8, the cylinder block 9, and the valve plate 4) provided in the casing 2 are fitted to the rotating shaft 3. Here, first, the support base 23 and the swash plate 5 are attached to the casing main body 21. Next, the rotating shaft 3 is inserted into the spherical bushing 8, and the spherical bushing 8 and the rotating shaft 3 are coupled to each other by the coupling member 53. With this, the movement of the spherical bushing 8 relative to the rotating shaft 3 toward the rear side in the axial direction is restricted. Then, the shoes 6, the pistons 10, and the retainer plate 7 are fitted to the rotating shaft 3 from the axial front end of the rotating shaft 3 toward the rear side. Further, the cylinder block 9 is fitted to the rotating shaft 3 from the axial rear end of the rotating shaft 3 toward the front side, and the pistons 10 are inserted into the bore holes 91. Here, the set spring 20 is arranged between the spherical bushing 8 and the cylinder block 9. Further, the valve plate 4 is fitted to the rotating shaft 3 from the axial rear end of the rotating shaft 3 toward the front side.

Next, the casing main body 21 is fitted to the rotating shaft 3 from the axial front end of the rotating shaft 3 toward the rear side, and the rear cover 22 is fitted to the rotating shaft 3 from the axial rear end of the rotating shaft 3 toward the front side. Then, the casing main body 21 and the rear cover 22 are coupled to each other. Before the casing main body 21 and the rear cover 22 are coupled to each other, the bearing 25 is attached between the rotating shaft 3 and the rear cover 22.

Next, the rotating shaft 3 is further moved toward the front side in the axial direction relative to the casing 2. Thus, the spherical bugling 8, the retainer plate 7, the shoes 6, and the swash plate 5 are brought into tight contact with one another in the axial direction. Here, the rotating shaft 3 is pulled toward the front side in the axial direction from the casing 2 to be moved toward the front side in the axial direction relative to the casing 2.

Next, the stop ring 33*b* is fitted in the groove 33*a* of the rotating shaft 3. With this, the flange portion 33 is formed at the rotating shaft 3. Then, the bearing 26 is attached at the front side of the casing 2. The bearing 26 and the gap adjusting member 36 are fitted in this order to the rotating shaft 3 from the axial front end of the rotating shaft 3 toward the rear side, and the stopper 35 is further attached to the rotating shaft 3. Finally, the front cover 28 is fixed to the casing main body 21. The pump 1B can be assembled by the above assembling procedure.

Embodiment 4

Next, Embodiment 4 will be explained. The following will explain a swash plate type axial piston pump (hereinafter simply referred to as a "pump 1C") according to Embodiment 4 including a first movement restricting mechanism 80C that is different from the first movement restricting mechanism 80 of Embodiment 1. It should be noted that the pump 1C is different from the pump 1 of Embodiment 1 mainly regarding the first movement restricting mechanism 80. Therefore, in the explanation of the present embodiment, the same reference signs are used for the same or similar components as in Embodiment 1, and a repetition of the same explanation may be avoided.

Figure 10:
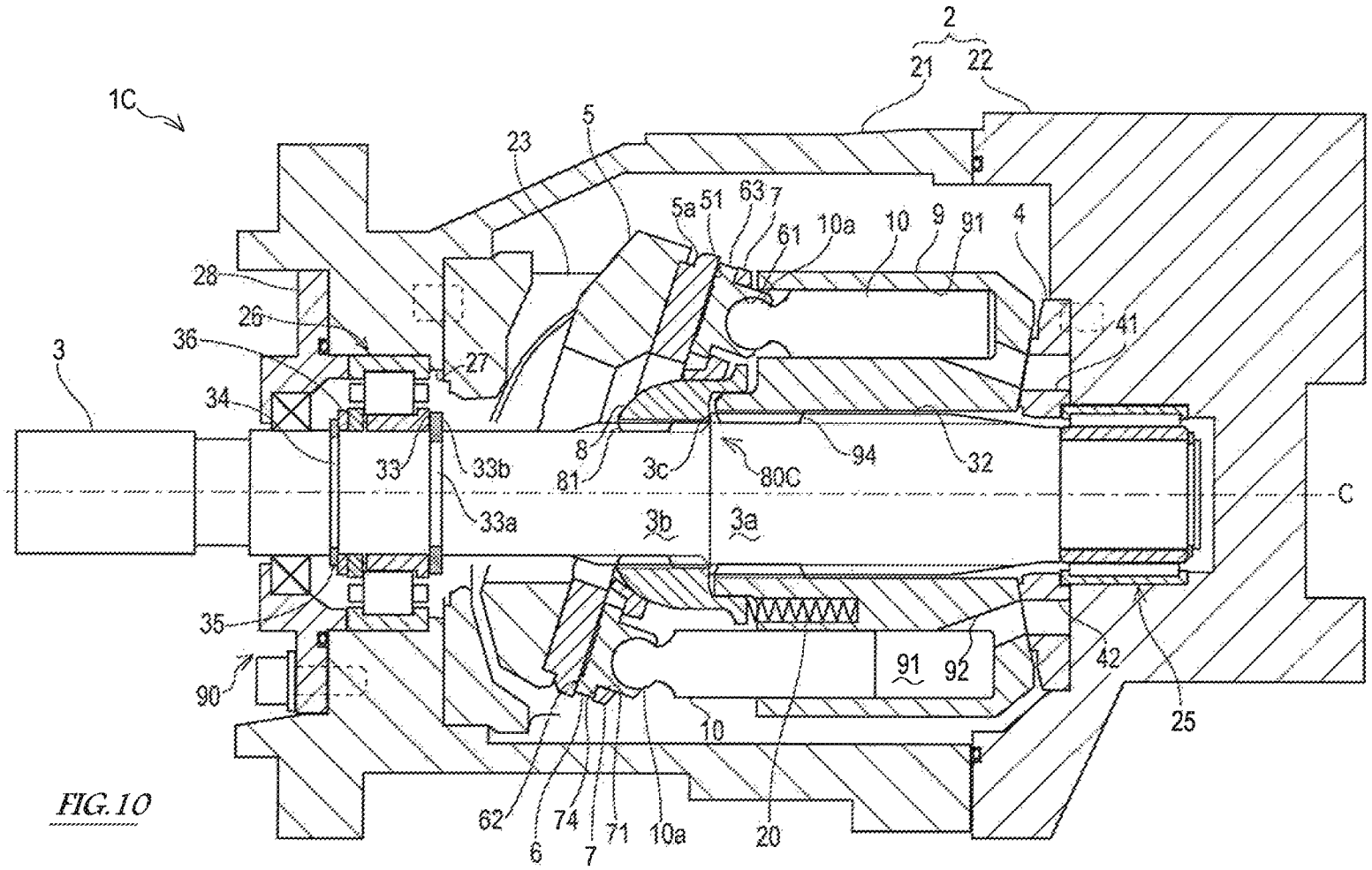
FIG. 10 is a diagram showing an entire configuration of the swash plate type axial piston pump according to Embodiment 4 of the present invention.
Figure 11:
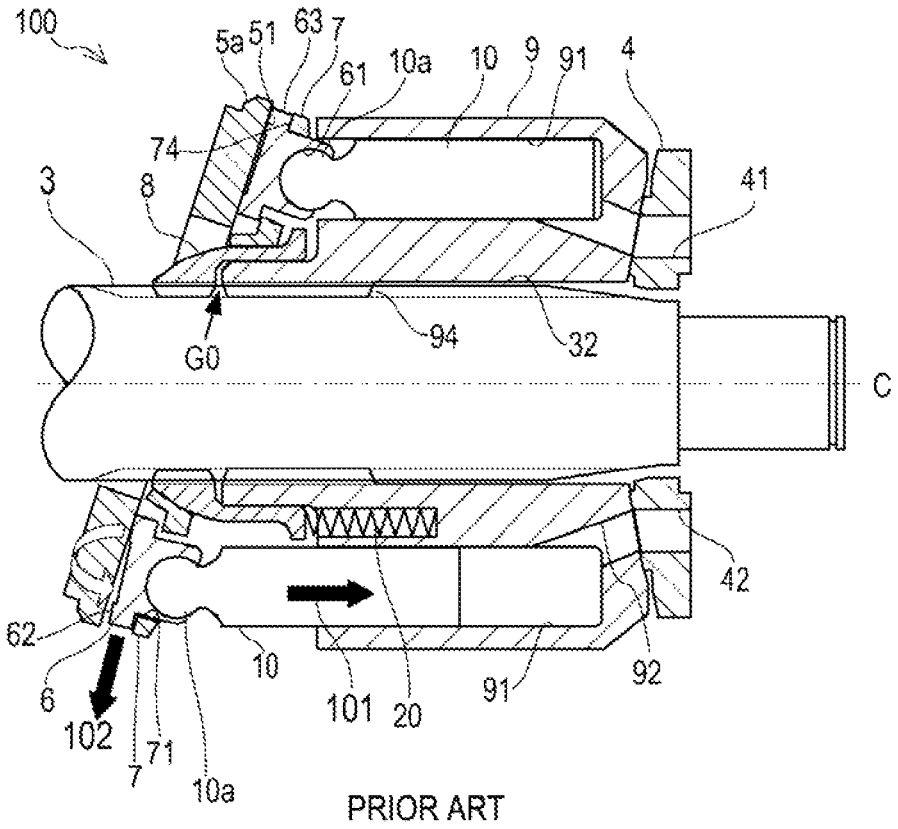
FIG. 11 is a diagram showing one example of a conventional, typical swash plate type liquid-pressure rotating device.

FIG. 10 is a schematic configuration of the pump 1C according to Embodiment 4. In the pump 1C, the rotating shaft 3 includes: a large-diameter portion 3*a* that is an axial rear portion; and a small-diameter portion 3*b* that is an axial front portion. A boundary between the large-diameter portion 3*a* and the small-diameter portion 3*b* in the axial direction is located between the spherical bushing 8 and the cylinder block 9. Since an outer diameter of the large-diameter portion 3*a* is larger than that of the small-diameter portion 3*b*, a step portion 3*c* is formed at a boundary between the large-diameter portion 3*a* and the small-diameter portion 3*b* by the difference of the outer diameters.

The cylinder block 9 is externally fitted to the large-diameter portion 3*a* of the rotating shaft 3. Further, the spherical bushing 8 is externally fitted to the small-diameter portion 3*b* of the rotating shaft 3. The receiving seat that is an axial rear end of the spherical bushing 8 contacts a stepped surface of the step portion 3*c*. As above, when the spherical bushing 8 contacts the stepped surface of the step portion 3*c*, the movement of the spherical bushing 8 relative to the rotating shaft 3 toward the rear side in the axial direction is restricted.

Further, in the pump 1C, the flange portion 33 of the rotating shaft 3 is constituted by an annular groove 33*a* formed around the rotating shaft 3; and a stop ring 33*b* fitted in the groove 33*a*. With this, the components such as the spherical bushing 8 and the retainer plate 7 can be fitted to the rotating shaft 3 from the axial front end of the rotating shaft 3 toward the rear side.

Next, one example of a procedure of assembling the pump 1C will be explained.

First, the casing main body 21 and the components (i.e., the swash plate 5, the shoes 6, the retainer plate 7, the spherical bushing 8, the cylinder block 9, and the valve plate 4) provided in the casing 2 are fitted to the rotating shaft 3. Here, first, the support base 23 and the swash plate 5 are attached to the casing main body 21. Next, the shoes 6, the pistons 10, the retainer plate 7, and the spherical bushing 8 are fitted to the rotating shaft 3 from the axial front end of the rotating shaft 3 toward the rear side. Further, the cylinder block 9 is fitted to the rotating shaft 3 from the axial rear end of the rotating shaft 3 toward the front side, and the pistons 10 are inserted into the bore holes 91. Here, the set spring 20 is arranged between the spherical bushing 8 and the cylinder block 9. Further, the valve plate 4 is fitted to the rotating shaft 3 from the axial rear end of the rotating shaft 3 toward the front side.

Next, the casing main body 21 is fitted to the rotating shaft 3 from the axial front end of the rotating shaft 3 toward the rear side, and the rear cover 22 is fitted to the rotating shaft 3 from the axial rear end of the rotating shaft 3 toward the front side. Then, the casing main body 21 and the rear cover 22 are coupled to each other. Before the casing main body 21 and the rear cover 22 are coupled to each other, the bearing 25 is attached between the rotating shaft 3 and the rear cover 22.

Next, the movement of the spherical bushing 8 relative to the rotating shaft 3 toward the rear side in the axial direction is restricted. Here, the rotating shaft 3 is pulled toward the front side in the axial direction from the casing 2 to be moved toward the front side in the axial direction relative to the casing 2. When an axial rear portion of the spherical bushing 8 contacts the stepped surface of the step portion 3*c*, the movement of the spherical bushing 8 relative to the rotating shaft 3 toward the rear side in the axial direction is restricted.

Next, the rotating shaft 3 is further moved toward the front side in the axial direction relative to the casing 2. Thus, the spherical bushing 8, the retainer plate 7, the shoes 6, and the swash plate 5 are brought into tight contact with one another in the axial direction.

Next, the stop ring 33*b* is fitted in the groove 33*a* of the rotating shaft 3. With this, the flange portion 33 is formed at the rotating shaft 3. Then, the bearing 26 is attached at the front side of the casing 2. The bearing 26 and the gap adjusting member 36 are fitted in this order to the rotating shaft 3 from the axial front end of the rotating shaft 3 toward the rear side, and the stopper 35 is further attached to the rotating shaft 3. Finally, the front cover 28 is fixed to the casing main body 21. The pump 1C can be assembled by the above assembling procedure.

Each of the pumps 1A, 1B, and 1C according to Embodiments 2 to 4 can obtain the same effects as the pump 1 according to Embodiment 1. To be specific, in each of the pumps 1A, 1B, and 1C, the movement of the spherical bushing 8 relative to the rotating shaft 3 toward the rear side in the axial direction is restricted by the first movement restricting mechanism 80A, 80B, or 80C. Then, in a state where the spherical bushing 8, the retainer plate 7, the shoes 6, and the swash plate 5 tightly contact one another in the axial direction, the movement of the rotating shaft 3 relative to the casing 2 toward the rear side in the axial direction is restricted by the second movement restricting mechanism 90. With this, relative axial positions of the swash plate 5 and the retainer plate 7 are maintained constant, and the shoes 6 are prevented from floating or tilting over.

Further, according to the procedures of assembling the pumps 1A, 1B, and 1C, the gap which changes in size by the manufacturing errors of the components of each of the pumps 1A, 1B, and 1C remains only between the loose rib 48 of the bearing 26 and the stopper 35, that is, remains only outside the casing 2. Therefore, this gap can be measured without disassembling the pump 1, and the work of filling the gap is easy. Therefore, the assembly workability of the pump 1 improves, so that the productivity of the pump 1 can be improved.

The foregoing has explained preferred embodiments of the present invention. However, the swash plate type liquid-pressure rotating device to which the present invention is applied is not limited to the swash plate type axial piston pump. For example, the swash plate type liquid-pressure rotating device may be a swash plate type axial piston motor. Further, regardless of a detailed structure of the swash plate type liquid-pressure rotating device, the present invention is widely applicable to the swash plate type liquid-pressure rotating devices.

REFERENCE SIGNS LIST

1 swash plate type axial piston pump
2 casing
3 rotating shaft
31 outward groove (annular groove)
33 flange portion
35 stopper (first stopper member)
4 valve plate
5 swash plate
5*a* shoe plate
51 slide-contact surface
6 shoe
7 retainer plate
8 spherical bushing
84 first groove (inward groove)
85 second groove (inward groove)
86 boundary portion
9 cylinder block
91 bore hole
10 piston
20 set spring
25, 26 bearing
27 opening edge
36 gap adjusting member
45 outer ring
46 inner ring
47 roll element
48 loose rib
80 first movement restricting mechanism
88 C ring (second stopper member)
90 second movement restricting mechanism

The invention claimed is:

1. A swash plate type liquid-pressure rotating device comprising:

a casing;

a rotating shaft inserted through the casing;

a bearing through which the rotating shaft is rotatably supported by the casing;

a swash plate provided in the casing and including a slide-contact surface inclined relative to an axial direction parallel to a center axis of the rotating shaft, the axial direction includes a first direction and a second direction opposite to the first direction;

a shoe configured to slide on the slide-contact surface of the swash plate;

a retainer plate provided apart from the swash plate in the first direction and configured to sandwich the shoe together with the swash plate in the axial direction to hold the shoe;

a spherical bushing externally fitted to the rotating shaft and configured to sandwich the shoe and the retainer plate together with the swash plate in the axial direction to support the retainer plate such that the retainer plate is swingable;

a movement restricting mechanism configured to restrict a movement of the spherical bushing relative to the rotating shaft toward the first direction;

a first stopper member provided apart from the bearing in the second direction and attached to the rotating shaft; and a gap adjusting member configured to be inserted into a gap, formed between the first stopper member and the bearing in the axial direction when the spherical bushing, the retainer plate, the shoe, and the swash plate tightly contact one another in the axial direction, to restrict a movement of the rotating shaft relative to the casing in the axial direction, wherein:

the bearing includes an outer ring having a surface directed in the first direction contacting the casing, an inner ring externally fitted to the rotating shaft at an inner peripheral side of the outer ring, a plurality of rolling elements provided between the outer ring and the inner ring and contacting a surface of the outer ring directed in the second direction, and a loose rib having a surface directed in the second direction contacting the gap adjusting member and a surface directed in the first direction contacting the plurality of rolling elements; and the inner ring is slidable relative to the plurality of rolling elements in the axial direction.

2. The swash plate type liquid-pressure rotating device according to claim 1, wherein a size of the gap adjusting member in the axial direction is adjustable.

3. The swash plate type liquid-pressure rotating device according to claim 1, wherein the movement restricting mechanism includes:

an annular groove formed on an outer peripheral surface of the rotating shaft;

a second stopper member externally fitted to a periphery of the annular groove; and a receiving seat formed on an inner peripheral surface of the spherical bushing and contactable with the second stopper member in the axial direction.

4. The swash plate type liquid-pressure rotating device according to claim 1, wherein the movement restricting mechanism includes a restricting member provided at the rotating shaft and projecting from an outer peripheral surface of the rotating shaft, the restricting member having a surface directed in the second direction contacting the spherical bushing.

5. The swash plate type liquid-pressure rotating device according to claim 1, wherein the movement restricting mechanism includes a coupling member configured to couple the spherical bushing and the rotating shaft.

6. The swash plate type liquid-pressure rotating device according to claim 1, wherein the movement restricting mechanism includes a step portion formed at the rotating shaft, the step has a surface directed in the second direction contacting the spherical bushing.

* * * * *